US006880192B2

(12) United States Patent
Lee et al.

(10) Patent No.: US 6,880,192 B2
(45) Date of Patent: Apr. 19, 2005

(54) WASHING MACHINE WITH FLOAT TYPE CLUTCH AND CONTROL METHOD FOR THE FLOAT TYPE CLUTCH

(75) Inventors: Tae Hee Lee, Seoul (KR); Jin Woong Kim, Gwangmyung-si (KR); Si Moon Jeon, Seoul (KR)

(73) Assignee: LG Electronics Inc., Seoul (KR)

( * ) Notice: Subject to any disclaimer, the term of this patent is extended or adjusted under 35 U.S.C. 154(b) by 239 days.

(21) Appl. No.: 10/157,083

(22) Filed: May 30, 2002

(65) Prior Publication Data

US 2003/0110575 A1 Jun. 19, 2003

(30) Foreign Application Priority Data

Dec. 14, 2001 (KR) ..... 2001-79597
Dec. 14, 2001 (KR) ..... 2001-79598

(51) Int. Cl.[7] ..... D06F 37/40
(52) U.S. Cl. ..... 8/159; 68/23.6; 68/23.7
(58) Field of Search ..... 68/133, 23.6, 23.7; 8/158, 159

(56) References Cited

U.S. PATENT DOCUMENTS 3,832,870 A * 9/1974 Todd-Reeve ..... 68/20
5,150,589 A * 9/1992 Williams et al. ..... 68/23.7
5,586,455 A * 12/1996 Imai et al. ..... 68/12.02
5,651,277 A * 7/1997 Richardson ..... 68/23.7
5,661,990 A * 9/1997 Chong ..... 68/23.6

FOREIGN PATENT DOCUMENTS

KR 95011604 B1 10/1995

* cited by examiner

*Primary Examiner*—Frankie L. Stinson
(74) *Attorney, Agent, or Firm*—Birch, Stewart, Kolasch & Birch, LLP

(57) ABSTRACT

Disclosed is a washing machine with a float type clutch in which a float connects a rotating force from a motor to a spin-drying shaft or disconnects the rotating force from the spin-drying shaft as it is upwardly or downwardly moved in accordance with supply or drainage of wash water, thereby allowing a washing operation or a dehydrating operation to be carried out, while forming an air layer for preventing wash water from reaching gears included in the float type clutch. A clutch control method in the washing machine with the float type clutch is also disclosed which involves an algorithm for determining whether or not the float is engaged with or disengaged from the spin-drying shaft, and executing an engagement or disengagement operation based on the determined result, and an algorithm for discriminating whether or not the engagement or disengagement is achieved in accordance with the float engagement/disengagement determining algorithm, thereby achieving an improvement in the reliability of float engagement/disengagement operations.

21 Claims, 10 Drawing Sheets

WASHING MACHINE WITH FLOAT TYPE CLUTCH AND CONTROL METHOD FOR THE FLOAT TYPE CLUTCH

BACKGROUND OF THE INVENTION

1. Field of the Invention

The present invention relates to a washing machine with a float type clutch and a control method for the float type clutch. More particularly, the present invention relates to a washing machine with a float type clutch in which a float connects a rotating force from a motor to a spin-drying shaft or disconnects the rotating force from the spin-drying shaft as it is upwardly or downwardly moved in accordance with supply or drainage of wash water, thereby allowing a washing operation or a dehydrating operation to be carried out, while forming an air layer for preventing wash water from reaching gears included in the float type clutch. The present invention also relates to a clutch control method in the washing machine with the float type clutch which involves an algorithm for determining whether or not the float is engaged with or disengaged from the spin-drying shaft, and executing an engagement or disengagement operation based on the determined result, and an algorithm for discriminating whether or not the engagement or disengagement is achieved in accordance with the float engagement/disengagement determining algorithm, thereby achieving an improvement in the reliability of float engagement/disengagement operations.

2. Description of the Related Art

Generally, a washing machine including a float type clutch has a configuration in which a float is spline-coupled to a wash shaft in such a fashion that it moves vertically along the wash shaft in accordance with supply and drainage of wash water between the bottom of a pulsator and a wash tub, thereby performing switching-on and -off of power supply.

That is, the float is separated from the spin-drying shaft during washing and rinsing operations as it is raised by wash water. Accordingly, the rotating force from the motor is transmitted only to the wash shaft, thereby causing the pulsator to perform washing and rinsing operations while rotating normally and reversely. When the wash water is drained after completion of the washing and rinsing operations, the float is lowered by its weight, so that it is coupled with the spin-drying shaft. Accordingly, the wash tub performs a dehydrating operation as it is rotated in one direction at a high speed.

FIG. 1 is a sectional view illustrating a part of a washing machine with a conventional float type clutch.

The configuration of the washing machine will be described in conjunction with FIG. 1.

As shown in FIG. 1, the washing machine includes a water reservoir tub 12, a wash tub 14 rotatably received in the water reservoir tub 12, and a pulsator 16 mounted to the wash tub 14 in the interior of the wash tub 14 and adapted to wash clothes while rotating normally and reversely in accordance with a rotating force transmitted from a drive motor 22 to a wash shaft 74. The drive motor 22, which is also included in the washing machine, supplies power for rotating the wash tub 14 and pulsator 16. The washing machine further includes a float type clutch 60 for selectively connecting the wash tub 4 and pulsator 16 in accordance with whether or not wash water is present, and a transmission 70 for transmitting the power from the drive motor 22 to the wash tub 14 and pulsator 16. The transmission 70 includes a hollow spin-drying shaft 72 fixedly coupled to the wash tub 14. The wash shaft 74 is also included in the transmission 70. The wash shaft 74 is fixedly coupled at an upper end thereof to the pulsator 16 while being connected at a lower end thereof to the drive motor 22. The transmission 70 also includes a plurality of bearings 76 for supporting the spin-drying shaft 72.

The float type clutch 60 includes a float 62 serration-coupled to the wash shaft 74 in such a fashion that it moves vertically in accordance with supply and drainage of wash water, and a fixed member 63 fixedly mounted to the upper end of the spin-drying shaft 72, and separably coupled with the float 62.

The float 62 includes a hub portion 621 serration-coupled to the wash shaft 74, and a tube portion 622 arranged around the hub portion 621. The hub 621 has a serrated structure at a lower surface thereof, whereas the tube section 622 has a closed hollow structure.

The fixed member 63 has a serrated structure at an upper surface thereof so that it is engaged with the lower surface of the hub portion 621 included in the float 62.

FIGS. 2 and 3 illustrate the operation of the above described washing machine provided with the conventional float type clutch. Now, the operation of the washing machine will be described in conjunction with FIGS. 2 and 3.

When wash water is supplied into the wash tub 14 in accordance with a water supplying operation, the float 62 is raised by the supplied wash water, so that it is separated from the fixed member 63. As a result, the float type clutch 60 is shifted to its power cut-off position, thereby causing the power from the drive motor 22 to be transmitted only to the wash shaft 74.

Thus, a washing operation is begun. When the drive motor 22 operates in accordance with the washing operation, the pulsator 16 connected to the wash shaft 74 is rotated. Since the drive motor 22 performs alternating normal and reverse rotations, the pulsator 16 performs corresponding normal and reverse rotations.

In accordance with the rotating operation of the pulsator 16, a vortex flow of wash water is formed. When the pulsator 16 rotates continuously in one direction for a predetermined time or more, the wash tub 14 is also rotated in the same direction as the pulsator 16 by virtue of the vortex flow of wash water. As a result, a centrifugal force is generated. This centrifugal force acts to outwardly discharge the wash water from the wash tub 14. The discharged wash water is introduced again into the wash tub 14 after passing through a fluid path defined between the wash tub 14 and the water reservoir tub 12. Thus, centrifugal washing in the manner of so called "waterfall washing" can be carried out.

Following the washing operation, rinsing and dehydrating operations are sequentially carried out. Prior to the dehydrating operation, rinsing water used in the rinsing operation is drained. When the rinsing water is drained, the float 62 is lowered by its weight, so that it is engaged with the fixed member 63. That is, the float type 60 is shifted to its power transmission position.

When the wash shaft 74 is rotated in accordance with the operation of the drive motor 22 in this state, the float 62 serration-coupled to the wash shaft 74 is rotated. Accordingly, the fixed member 63 engaged with the hub portion 621 of the float 62, and the wash tub 14 connected to the fixed member 63 are also rotated in the same direction as the wash shaft 74.

As the wash tub 14 rotates rapidly in one direction, a centrifugal force is generated, thereby causing the clothes in the wash tub 14 to come into contact with the inner wall of the wash tub 14. In this state, spin-drying is carried out in accordance with the centrifugal force. That is, the clothes are spin-dried in accordance with the centrifugal force. The moisture removed from the clothes is drained through a plurality of holes 14*a* formed at the inner wall of the wash tub 14. Since the wash tub 14 rotates in the same direction as the pulsator 16, the clothes are not caught on the pulsator 16. Accordingly, it is possible to prevent the clothes from being damaged by the pulsator 16.

When a washing operation is carried out in the washing machine using the above mentioned float type clutch after the spin-drying operation or under the condition in which no washing has been performed for a prolonged period, the float 62 should be raised by wash water supplied for the washing operation so that it is separated from the fixed member 63, thereby preventing transmission of power to the wash tub 14.

However, this washing machine has a problem in that foreign matters formed from the clothes may be caught on the hub portion 621 of the float 62 or the fixed member 63 as they are outwardly discharged along with the wash water, because there is no structure capable of forming an air layer for preventing the wash water from being introduced between the hub portion 621 of the float 62 and the fixed member 63 when the float 62 is raised in accordance with an increase in the level of the wash water.

Where foreign matters such as lint are firmly caught between the hub portion 621 of the float 62 and the fixed member 63, the engagement between the hub portion 621 of the float 62 and the fixed member 63 may be maintained by a coupling frictional force exceeding the buoyancy of the float 62. In this case, the washing operation may be carried out under the condition in which the float 62 is not separated from the fixed member 63 by the supplied wash water. As a result, the hub portion 621 of the float 62 and the fixed member 63 generate noise while being abraded. Furthermore, the entire rotating structure of the washing machine including the wash tub is rotated, thereby causing the drive motor 22 to be overloaded.

Although the float hub portion of 621 is lowered to engage with the fixed member 63 in the dehydrating operation, the engagement may be inaccurately made. In this case, slippage may occur between gears, thereby causing those gears to be abraded during their rotation for the spin-drying. Furthermore, the gears may interfere with each other, thereby generating considerable noise. In severe cases, it may be impossible to achieve a normal dehydrating operation.

SUMMARY OF THE INVENTION

Therefore, the present invention has been made in view of the above mentioned problems, and an object of the invention is to provide a washing machine with a float type clutch in which a float connects a rotating force from a motor to a spin-drying shaft or disconnects the rotating force from the spin-drying shaft as it is upwardly or downwardly moved in accordance with supply or drainage of wash water, thereby allowing a washing operation or a dehydrating operation to be carried out, while forming an air layer for preventing wash water from reaching gears included in the float type clutch.

Another object of the invention is to provide a clutch control method in the washing machine with the float type clutch which involves an algorithm for determining whether or not the float is engaged with or disengaged from the spin-drying shaft, and executing an engagement or disengagement operation based on the determined result, and an algorithm for discriminating whether or not the engagement or disengagement is achieved in accordance with the float engagement/disengagement determining algorithm, thereby achieving an improvement in the reliability of float engagement/disengagement operations.

The washing machine of the present invention can prevent foreign matters such as lint contained in wash water from being caught between gears of the float type clutch when the wash water is drained, thereby achieving reliable gear engagement and disengagement operations of the float type clutch. That is, the washing machine of the present invention has a superior effect capable of greatly improving the reliability to prevent foreign matters from being caught.

The clutch control method of the present invention has a superior effect capable of greatly improving the reliability of float engagement/disengagement operations.

BRIEF DESCRIPTION OF THE DRAWINGS

The above objects, and other features and advantages of the present invention will become more apparent after a reading of the following detailed description when taken in conjunction with the drawings, in which.

DESCRIPTION OF THE PREFERRED EMBODIMENTS

Now, a washing machine with a float type clutch according to the present invention and a method for controlling the float type clutch in accordance with the present invention will be described in detail with reference to the annexed drawings.

First, the washing machine with the float type clutch according to the present invention will be described.

Figure 1:
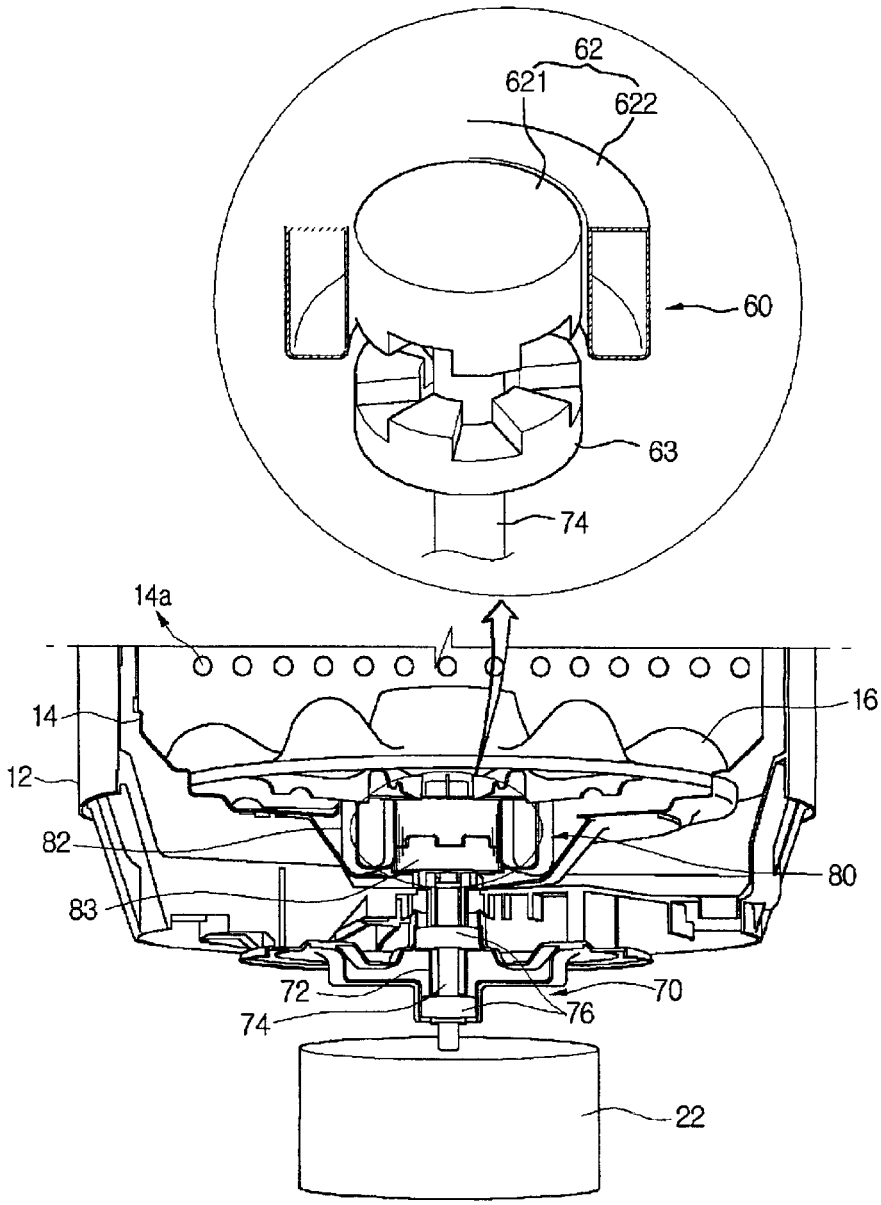
FIG.1 (PRIOR ART)
FIG. 1 is a sectional view illustrating a part of a washing machine with a conventional float type clutch.
Figure 2:
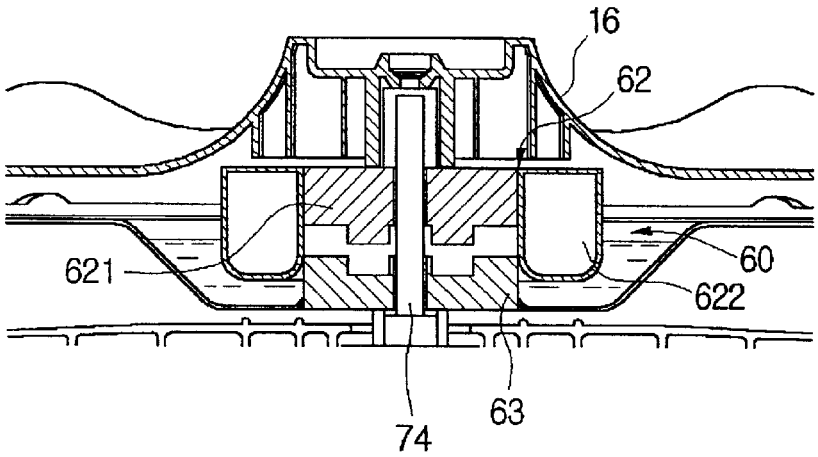
FIG.2 (PRIOR ART)
FIG. 2 is a view illustrating an operation of the conventional float type clutch in a washing operation of the washing machine.
Figure 3:
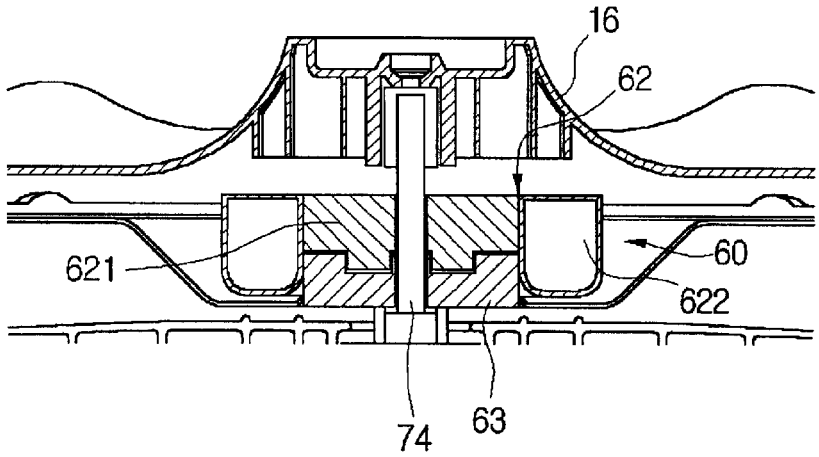
FIG.3 (PRIOR ART)
FIG. 3 is a view illustrating an operation of the conventional float type clutch in a spin-drying operation of the washing machine.
Figure 4:
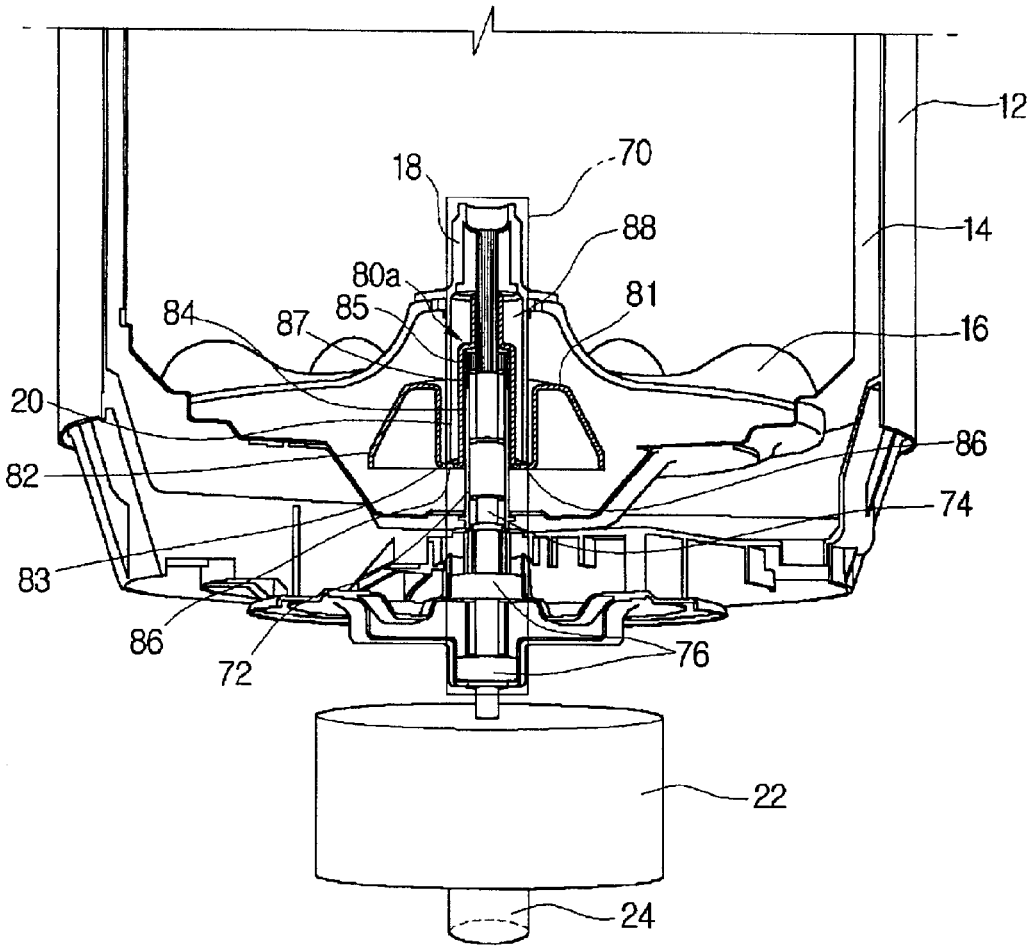
FIG. 4 is a sectional view illustrating the washing machine with the float type clutch according to the present invention.

FIG. 4 is a sectional view illustrating the washing machine with the float type clutch according to the present invention.

The configuration of this washing machine will be described with reference to FIG. 4.

The washing machine includes a drive motor 22, a water reservoir tub 12 for containing wash water to be supplied in a washing operation, a wash tub 14 received in the water reservoir tub 12, a pulsator 16 rotatably mounted to the bottom of the wash tub 14, a hollow spin-drying shaft 72 for rotating the wash tub 14 in accordance with a rotating force from the drive motor 22, a wash shaft 74 extending through the spin-drying shaft 72 while being fixedly connected at an upper end thereof to a wash shaft coupling member 18 coupled to the pulsator 16 and at a lower end thereof to the drive motor 22 so as to normally and reversely rotate the pulsator 16 in accordance with the rotating force from the drive motor 22, and a transmission 70 including a plurality of bearings adapted to the spin-drying shaft 72 and serving to efficiently transmit the rotating force from the drive motor 22 to the wash tub 14 and pulsator 16.

The washing machine also includes a float type clutch including a float 81 having a floating portion 82 adapted to move upwardly or downwardly in accordance with whether or not wash water is present, a hollow cylindrical central portion 84 provided at the upper end of its inner surface with a float gear 85, and a "U"-shaped connecting portion 83 integrally connecting the floating portion 82 and central portion 84. The float type clutch also includes a spin-drying shaft gear 87 provided at the upper end of the spin-drying shaft 72 while having the same shape as the float gear 85 so that it is selectively engagable with the float gear 85 in accordance with a vertical movement of the float 81.

The washing machine further includes a barrier 20 formed at the lower end of the wash shaft coupling member 18 in such a fashion that it is integral with the wash shaft coupling member 18, and inserted into the connecting portion 83 of the float 81, and a rotation sensor 24 installed beneath the drive motor 22, and adapted to sense rotating pulses generated from the drive motor 22.

Figure 5:
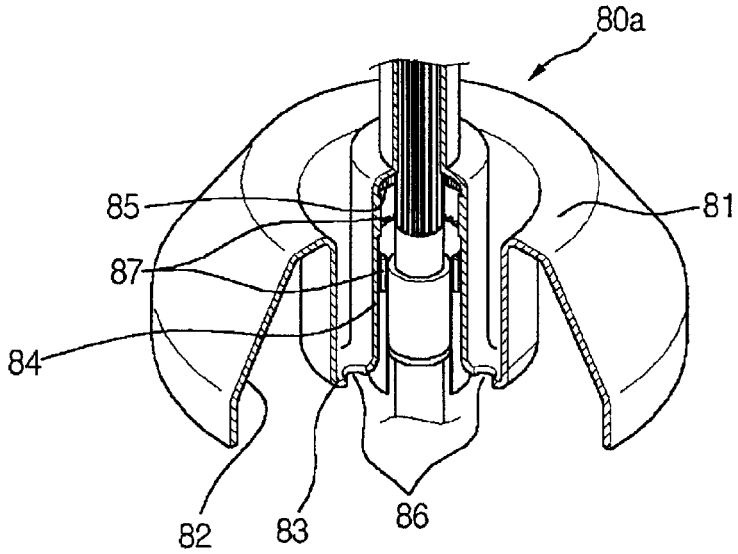
FIG. 5 is a perspective view illustrating the float type clutch according to the present invention.

FIG. 5 is a perspective view illustrating the float type clutch according to the present invention.

The configuration of the float type clutch according to the present invention will now be described in detail with reference to FIG. 5.

As shown in FIG. 5, the float type clutch, which is denoted by the reference numeral 80*a*, includes the float 81 having the floating portion 82, the hollow cylindrical central portion 84, and the "U"-shaped connecting portion 83 integrally connecting the floating portion 82 and central portion 84. The floating portion 82 is formed at a lower portion of the float 81 and defined with a space having a desired volume so that it is upwardly and downwardly moved along the wash shaft 74 in accordance with supply and drainage of wash water. The float gear 85, which is provided at the upper end of the inner surface of the cylindrical central portion 84, is engaged with the spin-drying shaft gear 87 provided at the upper end of the spin-drying shaft 72 when the float 81 is downwardly moved in accordance with drainage of wash water.

The barrier 20 is formed at the lower end of the wash shaft coupling member 18 so that it is seated at a lower end thereof on the bottom of the connecting portion 83 of the float 81 when the float 81 is upwardly moved in accordance with supply of wash water.

The float 81 also has through holes 86 having a desired diameter in order to form an air layer 88 inside the barrier 20. The through holes 86 are formed at the bottom of the connecting portion 83 connecting the floating portion 82 and central portion 84. As described above, the spin-drying shaft gear 87 is provided at the upper end of the spin-drying shaft 72 while having the same shape as the float gear 85. The spin-drying shaft gear 87 is engaged with the float gear 85 provided at the upper end of the cylindrical central portion 84 of the float 81 when the float 81 is downwardly moved by its weight in accordance with drainage of wash water, thereby causing the wash tub 14 and pulsator 16 to rotate simultaneously.

As shown in FIG. 5, the float 81 preferably has a conical structure so that it can move upwardly to a position where it comes into close contact with the lower surface of the pulsator 16 without any interference by the pulsator 16, thereby allowing the axial space occupied by the wash tub 14 and pulsator 16 constituting the washing machine to be reduced.

Now, the configuration of the washing machine with the float type clutch according to the present invention will be described in more detail.

The washing machine of the present invention is configured by incorporating the float type clutch 80*a* in the washing machine configuration described in conjunction with the related art.

As shown in FIGS. 4 and 5, the float type clutch 80*a* includes the float 81 and the spin-drying shaft gear 87. The float 81 is arranged between the pulsator 16 and the wash tub 14 so that it is upwardly and downwardly moved along the wash shaft 74 in accordance with supply and drainage of wash water. When the float gear 85 of the float 81 is engaged with the spin-drying shaft gear 87, the wash tub 14 and pulsator 16 are simultaneously rotated in accordance with rotation of the spin-drying shaft 72.

As shown in FIG. 5, the float 81 included in the float type clutch 80*a* has the floating portion 82 which is formed at a lower portion of the float 81 and defined with a space having a desired volume so that it is upwardly moved by the buoyancy of the wash water filled to a certain level between the pulsator 16 and the wash tub 14.

As described above, the float gear 85 is arranged at the upper end of the inner surface of the cylindrical central portion 84 integrally connected with the floating portion 82 by the "U"-shaped connecting portion 83 having a desired depth. The float gear 85 has a spline structure so that it is engaged with the spin-drying shaft gear 87 provided at the upper end of the spin-drying shaft 72 when the float 81 is downwardly moved in accordance with drainage of wash water.

The through holes 86, which have a desired diameter, are formed at the lower end of the connecting portion 83 adapted to connect the floating portion 82 and central portion 84, in order to prevent the air layer 88 formed inside the barrier 20 from moving outside the barrier 20. As described above, the barrier 20 is formed at the lower end of the wash shaft coupling member 18.

When the wash water is introduced into the space defined between the wash tub 14 and the pulsator 16, it enters the space defined inside the barrier 20 through the through holes 86. As a result, the air layer 88 present inside the barrier 20 is pressurized by the wash water rising in the space defined inside the barrier 20. Accordingly, the air layer 88 cannot escape from the space defined inside the barrier 20.

The wash water in the space defined inside the barrier 20 stops rising when its pressure is balanced with the pressure of the air layer 88 present inside the barrier 20. Accordingly, it is possible to prevent the wash water from rising up to the spin-drying gear 87 fitted in the central portion 84 of the float 81.

As shown in FIG. 5, the spin-drying shaft gear 87 is formed at the upper end of the spin-drying shaft 72 while having the same shape as the float gear 85 so that it is engagable with the float gear 85 formed at the upper end of the central portion 84 included in the float 81 when the float 81 is downwardly moved by its weight in accordance with the drainage of the wash water.

When the float gear 85 is engaged with the spin-drying shaft gear 87, the wash tub 14 and pulsator 16 are simultaneously rotated in accordance with rotation of the spin-drying shaft 72.

Figure 6:
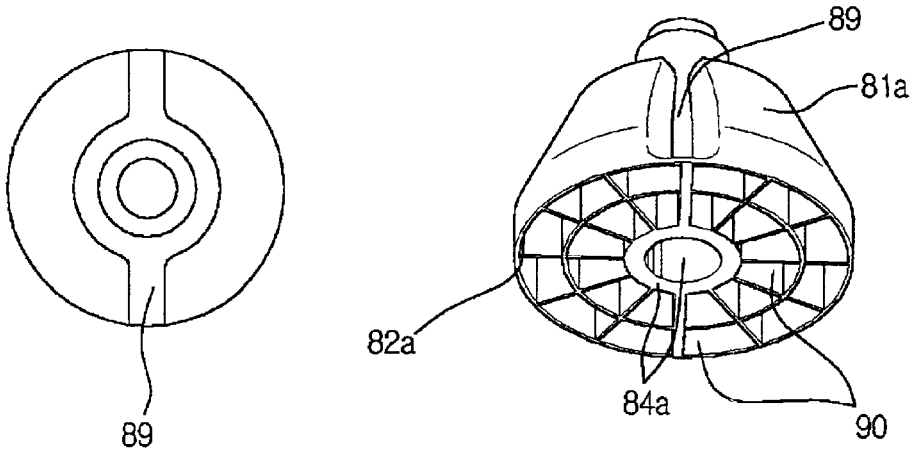
FIG. 6 illustrates another embodiment of the float included in the float type clutch according to the present invention.

FIG. 6 illustrates another embodiment of the float included in the float type clutch according to the present invention.

Referring to FIG. 6, a float 81*a* is shown. This float 81*a* includes a conical floating portion 82*a* provided with a plurality of wash water introduction slits 89, and a cylindrical central portion 84*a*. By virtue of the wash water introduction slits 89, wash water can be introduced around a cylindrical central portion 84*a*, so that an air layer 88 formed inside the barrier 20 extending from the lower end of the wash shaft coupling member 18 is prevented from moving outside the barrier 20. In order to minimize the amount of wash water introduced into the interior of the floating portion 82*a*, a plurality of spaces 90 are arranged in the form of a lattice at the lower side of the floating portion 82*a*.

When wash water is introduced into the interior of the float 81*a*, the air layer 88 present inside the barrier 20 is pressurized by the wash water rising in the space defined inside the barrier 20. The wash water in the space defined inside the barrier 20 stops rising when its pressure is balanced with the pressure of the air layer 88 present inside the barrier 20. Accordingly, it is possible to prevent the wash water from rising up to the spin-drying gear 87 fitted in the central portion 84*a* of the float 81*a*.

When the wash water is drained after completion of the washing operation, foreign matters contained in the wash water may be left in the space between the pulsator 16 and the wash tub 14 without being discharged from that space. However, although wash water is introduced again into the space between the pulsator 16 and the wash tub 14, the foreign matters left in the space between the pulsator 16 and the wash tub 14 cannot reach the spin-drying shaft gear 87 and float gear 85 because the wash water cannot reach the spin-drying shaft gear 87 and float gear 85. Thus, a desired reliability is achieved.

Wash water may be introduced into the interior of the floating portion 82*a* through the lower side of the floating portion 82*a* as it is agitated when the float type clutch 81*a* is rotated along with the wash shaft 74 and pulsator 16 during the washing operation. However, the introduced wash water enters only a part of the spaces 90 by virtue of the lattice shape of those spaces 90. Accordingly, it is possible to prevent the floating portion 82*a* from losing its buoyancy.

Figure 7:
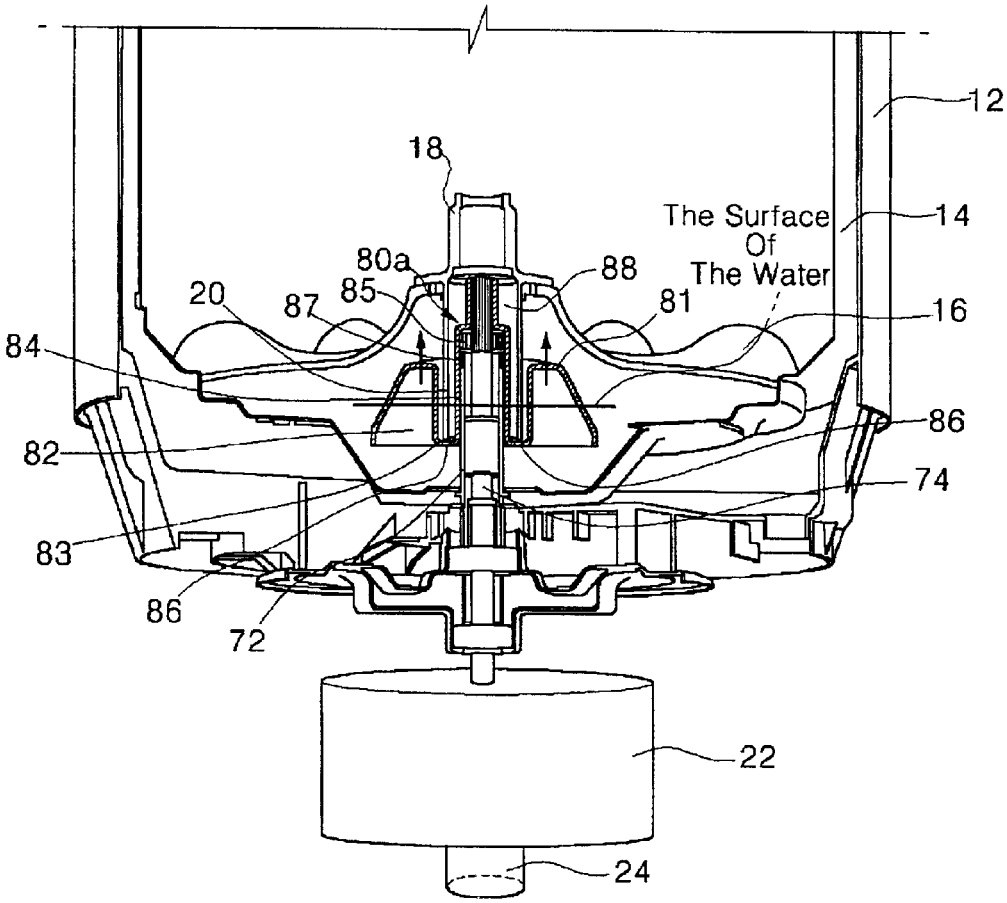
FIG. 7 is a view illustrating an operation of the float type clutch in a washing operation of the washing machine according to the present invention.
Figure 8:
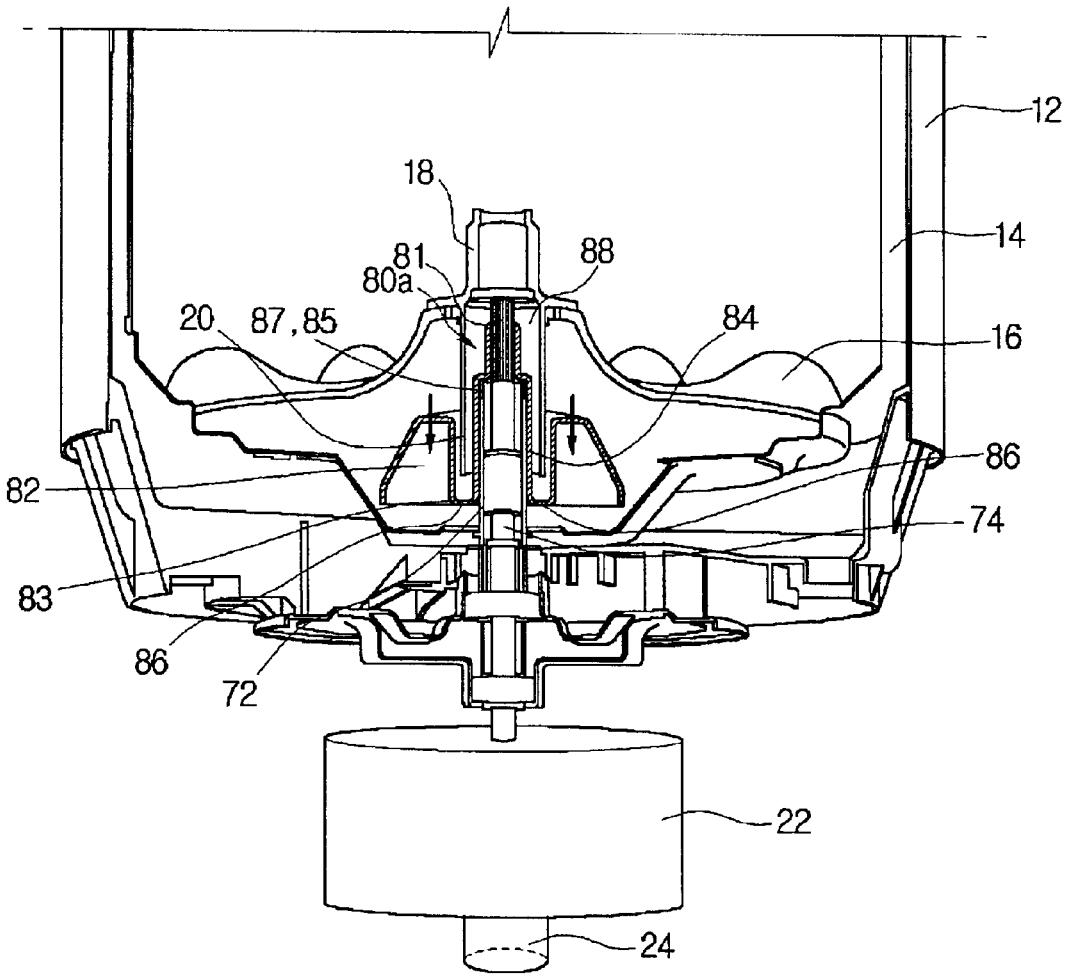
FIG. 8 is a view illustrating an operation of the float type clutch in a spin-drying operation of the washing machine according to the present invention.

FIGS. 7 and 8 illustrate operations of the float type clutch performed in the washing and spin-drying operations of the washing machine according to the present invention, respectively.

Respective operations of the float type clutch performed in the washing and spin-drying operations of the washing machine according to the present invention will now be described in conjunction with FIGS. 7 and 8.

When wash water is supplied into the wash tub 14 in accordance with a washing operation of the washing machine, the float 81 of the float type clutch 80*a* arranged between the wash tub 14 and the pulsator 16 is raised up to the lower surface of the pulsator 16 while being separated from the spin-drying shaft gear 87 in accordance with the buoyancy effect of the wash water.

As a result, the float type clutch 80*a* is shifted to its power cut-off state, so that the rotating force from the drive motor 22 is transmitted only to the wash shaft 74. In this state, the washing operation is carried out as the wash shaft 74, float 81, and pulsator 16 are simultaneously rotated in normal and reverse directions.

This operation will be described in more detail. When the wash water is introduced along the lower end of the float 81 into the interior of the float type clutch 80*a* arranged between the wash tub 14 and the pulsator 16, it gradually fills the floating portion 82 defined with a space having a desired volume, and the hollow cylindrical central portion 84. Accordingly, the float 81 is upwardly moved by virtue of the buoyancy of the wash water.

The upward movement of the float 81 is carried out as the air present in the floating portion 82 of the float 81 is compressed by the pressure of the rising wash water, so that the pressure of the air layer pressurized by the wash water exceeds the weight of the float 81, thereby lightening the float 81.

The float 81 is raised to a certain level, that is, the lower surface of the pulsator 16. When the wash water is no longer introduced into the float 81 due to the presence of the air layer in the floating portion 82, the rising of the float 81 is stopped.

The wash water entering the floating portion 82 is also introduced into spaces respectively defined by the hollow cylindrical central portion 84 and the "U"-shaped connecting portion 83. As described above, the connecting portion 83 is configured to connect the floating portion 82 and central portion 84. The introduction of wash water into the connecting portion 83 is carried out through the through holes 86 formed at the lower end of the connecting portion 83. Wash water introduced through the through holes 86 is filled to a certain level upwardly spaced apart from the lower end of the connecting portion 83 under the condition in which the barrier 20 extending from the lower end of the wash shaft coupling member 18 is seated at the lower end thereof on the bottom of the connecting portion 83 of the float 81.

The air layer 88 formed inside the barrier 20 of the wash shaft coupling member 18 by the introduced wash water is increased in its pressure as the level of the wash water increases, because it is prevented from moving outside the barrier 20 along the lower end of the barrier 20.

The wash water introduced inside the central portion 84 of the float 81 prevents the air layer 88 formed inside the barrier 20 of the wash shaft coupling member 18 from moving outside the barrier 20. The air layer 88 present inside the barrier 20 and the air layer present inside the central portion 84 are pressurized by the rising wash water.

The wash water stops rising when its pressure is balanced with the pressure of the air layer 88 present inside the barrier 20 and the air layer present inside the central portion 84.

Accordingly, it is possible to prevent the wash water from rising up to the float gear 85 and the spin-drying gear 87.

After completion of the washing operation, a spin-drying operation is begun. For the spin-drying operation, the wash water contained in the wash tub 14 is first drained. As the wash water is drained, the float 81 of the float type clutch 80*a* raised up to the lower surface of the pulsator 16 is lowered by its weight, as shown in FIG. 8. As a result, the spin-drying gear 87 received in the central portion 84 of the float 81 is engaged with the float gear 85 formed at the inner surface of the central portion 84. Accordingly, the wash tub 14 and pulsator 16 are simultaneously rotated in one direction in accordance with rotation of the spin-drying shaft 72. Thus, the spin-drying operation is carried out to spin-dry the clothes received in the wash tub 14.

Although the floating portion of the float in the float type clutch according to the present invention has been described as having a conical shape, its shape is not limited thereto.

Now, a method for controlling the float type clutch in the washing machine according to the present invention will be described.

Figure 9A:
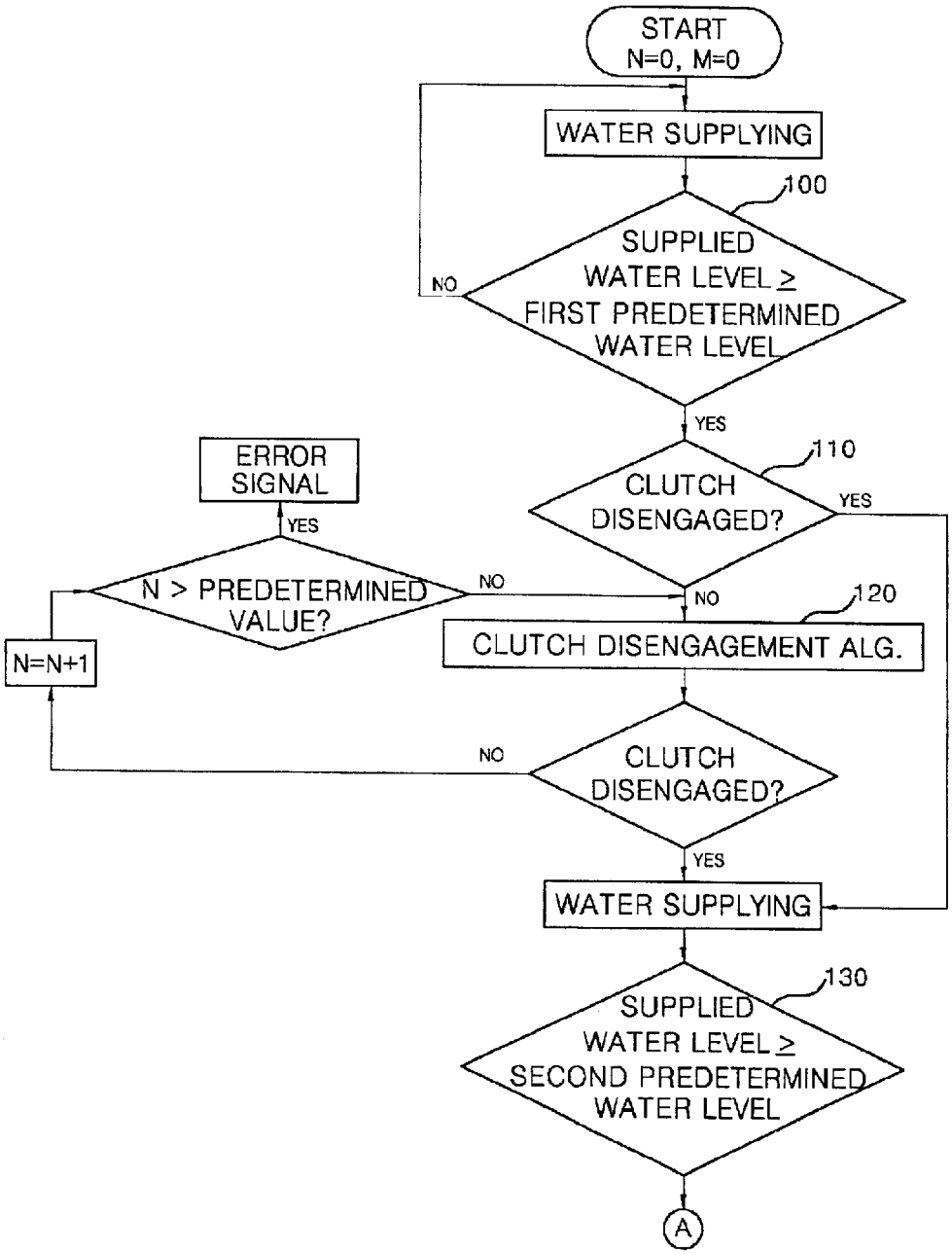
FIG. 9 is a flow chart illustrating a clutch control method in the washing machine according to the present invention.
Figure 9B:
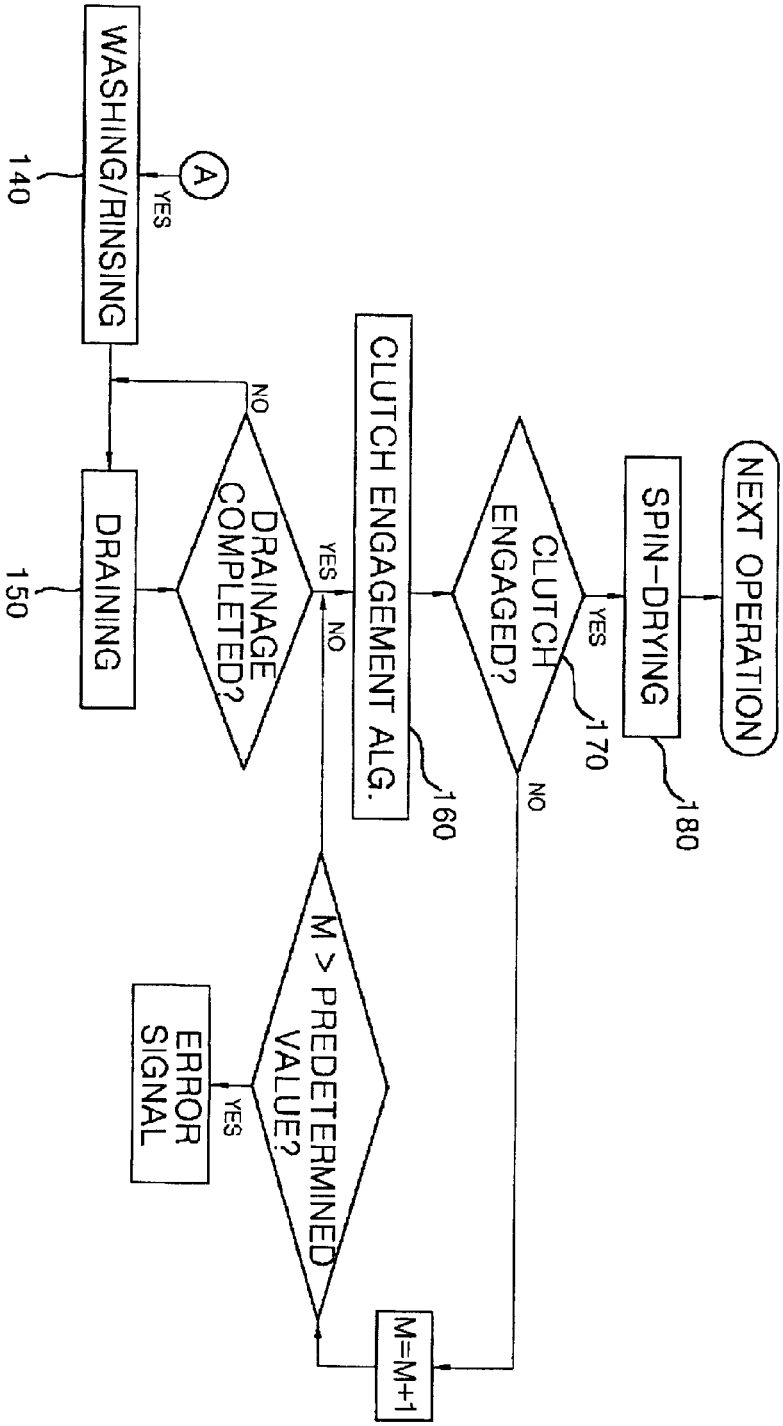

FIG. 9 is a flow chart illustrating the control method for the float type clutch in the washing machine according to the present invention.

The control method will be described in detail with reference to FIG. 9. As shown in FIG. 9, the control method involves:

- a first predetermined water level determining step 100 for determining whether or not wash water is supplied up to a first predetermined water level in a washing operation of the washing machine;
- a primary clutch operation discriminating algorithm executing step 110 for, when it is determined that wash water is supplied up to the first predetermined water level, determining, using a clutch operation discriminating algorithm, whether or not the float type clutch 80*a* is shifted to its disengagement state, that is, whether or not the float gear 85 is disengaged from the spin-drying shaft gear 87;
- a clutch disengagement algorithm executing step 120 for, when it is determined at step 110 that the float type clutch 80*a* is not shifted to its disengagement state, disengaging the float gear 85 from the spin-drying gear 87 in accordance with a clutch disengagement algorithm;
- a second predetermined water level determining step 130 for, when the float type clutch 80 is shifted to its disengagement state, beginning a water supplying operation, and determining whether or not wash water is supplied up to a second predetermined water level depending on an amount of clothes to be washed;
- a washing and rinsing step 140 for, when it is determined at step 130 that wash water is supplied up to the second predetermined water level, washing and rinsing the clothes contained in the wash tub 14 in accordance with washing and rinsing operations of the washing machine;
- a draining step 150 for draining the wash water after completion of the washing and rinsing operations for the clothes contained in the wash tub 14 at step 140;
- a clutch engagement algorithm executing step 160 for engaging the float gear 85, moving downwardly by its weight, with the spin-drying gear 87 in accordance with a clutch engagement algorithm, after completion of the wash water drainage;
- a secondary clutch operation discriminating algorithm executing step 170 for determining whether or not the float type clutch 80*a* is in its engagement state in accordance with the clutch engagement algorithm; and
- a spin-drying step 180 for, when it is determined at step 170 that the float type clutch 80*a* is in its engagement state, rotating the wash tub 14 in accordance with a spin-drying operation of the washing machine, thereby spin-drying the clothes.

This method will be described in more detail.

When a washing operation is begun in order to wash clothes, wash water is supplied up to the first predetermined water level so that the float type clutch 80*a* is shifted to its disengagement state, that is, the float gear 85 is disengaged from the spin-drying shaft gear 87 (Step 100). When the float gear 85 is disengaged from the spin-drying shaft gear 87, the rotating force from the drive motor 22 is transmitted only to the wash shaft 74, thereby causing the pulsator 16 to rotate normally and reversely. Thus, the pulsator 16 carries out the washing operation.

When the level of the wash water reaches the first predetermined water level, a clutch operation discriminating algorithm is executed in order to determine whether or not the float gear 85 of the float type clutch 80*a* is disengaged from the spin-drying shaft gear 87 by the buoyancy of the wash water (Step 110).

When it is determined by the clutch operation discriminating algorithm that the float type clutch 80 is shifted to its disengagement state, the procedure proceeds to the step at which the wash water is supplied up to the second predetermined water level in accordance with a secondary water supplying operation. On the other hand, where it is determined that the float type clutch 80*a* is not shifted to its disengagement state, a clutch disengagement algorithm is executed to normally and reversely drive the motor at short intervals, thereby generating impact for releasing the engagement of the float type clutch 80*a* (Step 120).

Thereafter, it is determined, in accordance with the clutch operation discriminating algorithm, whether or not the float type clutch 80*a* is shifted to its disengagement state, that is, the float gear 85 is disengaged from the spin-drying shaft gear 87.

Where it is determined by the clutch operation discriminating algorithm that the float type clutch 80*a* is shifted to its disengagement state, the procedure proceeds to the step at which the wash water is supplied up to the second predetermined water level in accordance with the secondary water supplying operation. On the other hand, where it is determined that the float type clutch 80*a* is not shifted to its disengagement state, the clutch disengagement algorithm is executed again (Step 120). Subsequently, it is determined again by the clutch operation discriminating algorithm whether or not the float type clutch 80*a* is shifted to its disengagement state.

When the float gear 85 of the float type clutch 80*a* is disengaged from the spin-drying shaft gear 87 in accordance with the above described procedure, wash water is supplied up to the second predetermined water level depending on the amount of clothes to be washed.

When it is determined that wash water is supplied up to the second predetermined water level (Step 130), the pulsator 16 of the washing machine is normally and reversely rotated by the rotating force from the drive motor 22 transmitted to the wash shaft 74 (Step 140). As the wash water is supplied up to the second predetermined water level, the float 81 of the float type clutch 80*a* is raised to the lower surface of the pulsator 16 by the buoyancy of the wash water.

After completion of the washing and rinsing procedure (Step 140), the wash water contained in the wash tub 14 is outwardly drained. When the wash water is drained to a level corresponding to an intermediate portion of the float type clutch 80*a*, that is, the lower end of the float 81, this float 81, raised to the lower surface of the pulsator 16 by the buoyancy of the wash water, is lowered by its own weight.

Although the draining procedure is completed, the float 81 may often be laid on the upper end of the spin-drying shaft gear 87 without being engaged with the spin-drying shaft gear 87 after being lowered. In order to reliably achieve the engagement of the float type clutch 80*a*, a clutch engagement algorithm is executed (Step 160). In accordance with the clutch engagement algorithm, the drive motor 22 repeatedly rotates in a normal direction for a short period of time, and then repeatedly rotates in a reverse direction for a short period of time. Thus, the float gear 85 is reliably engaged with the spin-drying shaft gear 87.

Thereafter, it is determined by the clutch operation discriminating algorithm whether or not the float type clutch 80*a* is in its engagement state, that is, the float gear 85 is in a state engaged with the spin-drying shaft gear 87 (Step 170).

Where the float type clutch 80*a* is in its engagement state, a spin-drying operation is carried out under the condition in which the spin-drying shaft 72, float type clutch 80*a*, and wash shaft 74 are rotated at high speed in one direction by the rotating force from the drive motor 22. On the other hand, where the float type clutch 80*a* is not in its engagement state, the clutch engagement algorithm is executed again (Step 160). Thereafter, the engagement of the float type clutch 80*a* is determined again in accordance with the clutch operation discriminating algorithm.

When it is determined by the above described procedure, that is, the clutch operation discriminating algorithm, that the float gear 85 of the float type clutch 80*a* is engaged with the spin-drying shaft gear 87, the spin-drying procedure is executed, thereby spin-drying the clothes contained in the wash tub 14 (Step 180). In accordance with the above described procedures, one cycle including washing, rinsing, and spin-drying operations is completed.

Figure 13:
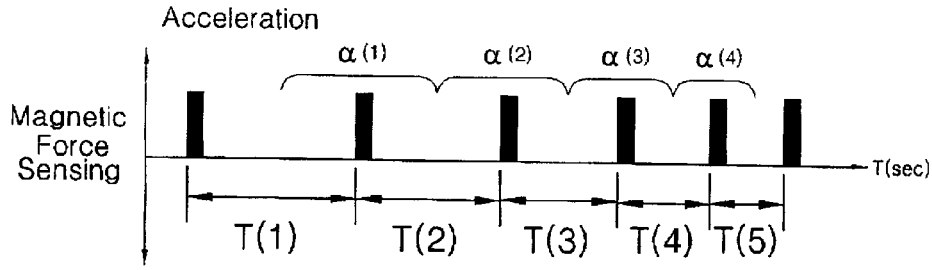
FIG. 13 is a diagram illustrating the clutch operation discriminating algorithm for discriminating operation of the float type clutch, based on the angular rotational acceleration of the drive motor.

As shown in FIG. 13, the clutch operation discriminating algorithm discriminates operation of the float type clutch 80*a*, based on the angular rotational acceleration of the drive motor 22 generated when the drive motor 22 rotates in one direction for a predetermined time. This will be described hereinafter.

Figure 10:
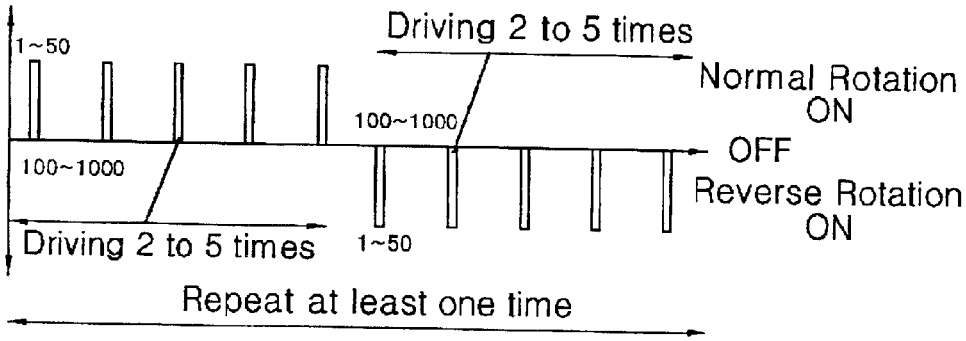
FIG. 10 is a diagram illustrating a clutch disengagement algorithm involved in the control method for the float type clutch according to the present invention.

FIG. 10 is a diagram illustrating the clutch disengagement algorithm involved in the control method for the float type clutch according to the present invention.

The clutch disengagement algorithm will now be described with reference to FIG. 10.

Although it is possible to release the engagement of the float gear 85 of the float type clutch 80*a* with the spin-drying shaft gear 87 using impact generated by normally and reversely rotating the drive motor 22 in an alternating fashion at short intervals, the clutch disengagement algorithm is configured to control the drive motor 22 to rotate repeatedly in a normal direction for a short period of time, and then to rotate repeatedly in a reverse direction for a short period of time. In this case, it is possible to effectively release the engagement force of the float type clutch 80*a* within a short period of time.

In accordance with the clutch disengagement algorithm, the drive motor 22 repeatedly, that is, 2 to 5 times, turns on for about 1 to 50 ms (milliseconds), and turns off for about 0.1 to 1 second in association with a normal direction of rotation, and then repeats, 2 to 5 times, the turn-on/off operation in association with a reverse direction of rotation. The entire operation is carried out at least one time. Alternatively, the drive motor 22 carries out the turn-on/off operation in an alternating fashion in association with normal and reverse directions of rotation. In the latter case, the entire operation is repeated 2 to 5 times.

Figure 11:
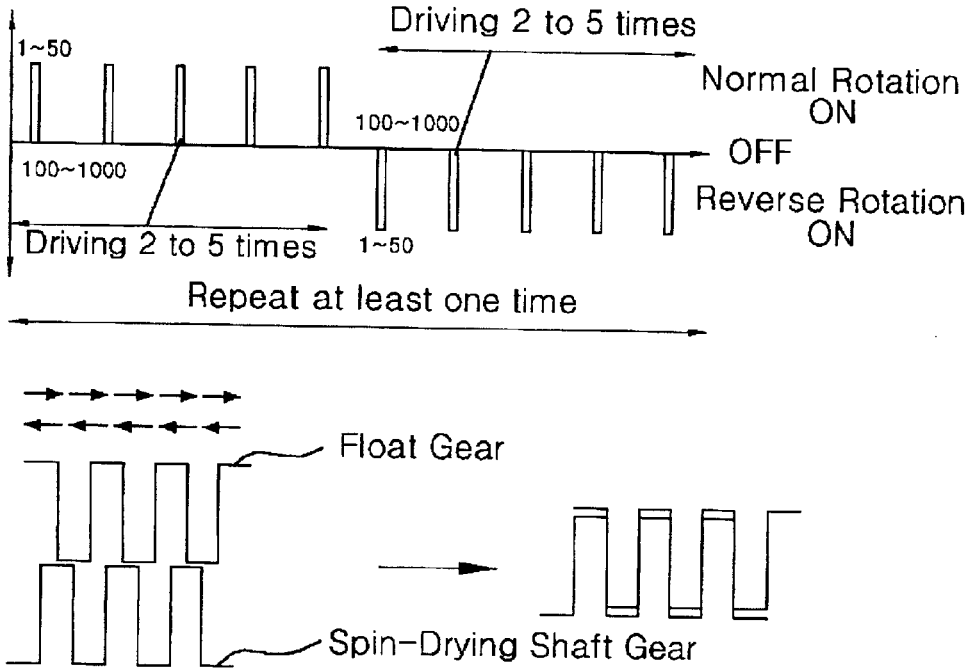
FIG. 11 is a diagram illustrating a clutch engagement algorithm involved in the control method for the float type clutch according to the present invention.

FIG. 11 is a diagram illustrating the clutch engagement algorithm involved in the control method for the float type clutch according to the present invention.

The clutch engagement algorithm will now be described with reference to FIG. 11.

The clutch engagement algorithm is configured to repeat, several times, rotation of the drive motor 22 for a short period of time in a normal direction, and then to repeat, several times, rotation of the drive motor 22 for a short period of time in a reverse direction, thereby reliably achieving a desired engagement of the float type clutch 80*a*.

However, where the spin-drying shaft gear 87 of the float type clutch 80 rotates in an amount exceeding its gear pitch, it cannot engage with the float gear 85 because each tooth thereof is not aligned with a space defined between associated adjacent teeth of the float gear 85. In order to avoid such a phenomenon, the rotating angle of the drive motor 22 for one driving interval is preferably set to be less than the gear pitch of the float gear 85 or spin-drying shaft gear 87. That is, for one driving interval of the drive motor 22, the spin-drying shaft gear 87 rotates in an amount not exceeding the gear pitch of the float gear 85 to be engaged therewith.

In accordance with the clutch engagement algorithm, the drive motor 22 repeatedly, that is, 2 to 5 times, turns on for about 1 to 50 ms (milliseconds), and turns off for about 0.1 to 1 second in association with a normal direction of rotation, and then repeats, 2 to 5 times, the turn-on/off operation in association with a reverse direction of rotation. The entire operation is carried out at least one time. Alternatively, the drive motor 22 carries out the turn-on/off operation in an alternating fashion in association with normal and reverse directions of rotation. In the latter case, the entire operation is repeated 2 to 5 times.

Now, a method for controlling engagement and disengagement of the float type clutch in washing, rinsing and spin-drying operations of the washing machine according to the present invention will be described in detail.

In order to reliably carry out the control method for the float type clutch, the rotation sensor 24 is installed beneath the drive motor 22. The rotation sensor 24 serves to sense rotating pulses generated from the drive motor 22. The configuration of the washing machine equipped with the rotation sensor 24 is shown in detail in FIG. 4.

Figure 12:
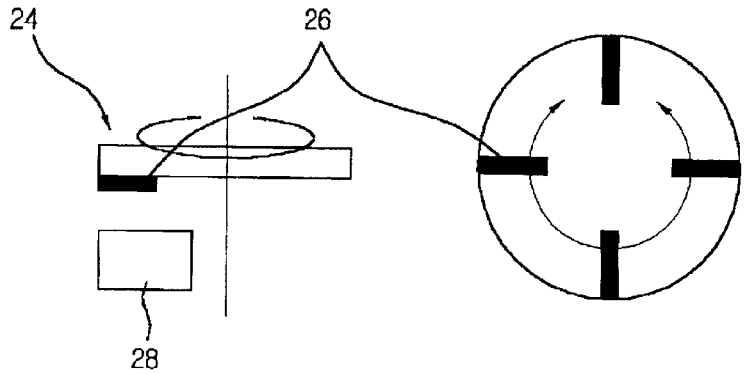
FIG. 12 is a schematic view illustrating the principle of a rotation sensor applied to the washing machine of FIG. 4.

FIG. 12 is a schematic view illustrating the principle of the rotation sensor applied to the washing machine of FIG. 4.

The principle of the rotation sensor applied to the washing machine according to the present invention will be described with reference to FIG. 12. As shown in FIG. 12, the rotation sensor 24 includes at least one magnet 26 arranged around the rotating axis of the drive motor 22 to rotate about the rotating axis in accordance with rotation of the drive motor 22, and a magnetic force sensor 28 arranged at a position where it can sense a magnetic force from the rotating magnet 26. The rotation sensor 24 senses the rotating speed of the drive motor 22, based on the difference between successive times at which the magnetic force sensor 28 senses the magnetic force from the rotating magnet 26. In the illustrated case, four magnets 26 are arranged. Accordingly, the rotation sensor 24 senses the magnets 26.

FIG. 13 is a diagram illustrating a method for discriminating operation of the float type clutch, based on the angular rotational acceleration of the drive motor.

The clutch operation discriminating method based on the angular rotational acceleration of the drive motor will be described with reference to FIG. 13.

Angular acceleration discriminated based on sensing times of the sensor 28 for the rotating magnets 26 can be expressed by the following Expression:

$$\alpha(i)=\{4\pi\cdot[T(i)-T(i+1)]\}/\{N\cdot T(i)\cdot T(i+1)\cdot[T(i)+T(i+1)]\} \quad \text{[Expression]}$$

where,

α(i): Average angular rotational acceleration for a period of time from an i-th sensing time to an "i+1"-th sensing time;

T(i): i-th sensing time;

N: Number of magnets;

Clutch engagement state: α(i)<first predetermined value;

Clutch disengagement state: α(i)>second predetermined value; and first predetermined value<second predetermined value.

Where the clutch 80*a* is in its disengagement state, the clutch operation discriminating algorithm discriminates the angular acceleration of the drive motor 22 to be more than the second predetermined value in accordance with the above described Expression because the load applied to the drive motor 22 is small. On the other hand, where the clutch 80*a* is in its engagement state, the clutch operation discriminating algorithm discriminates the angular acceleration of the drive motor 22 to be less than the first predetermined value in accordance with the above described Expression. Based on the discriminated result, it is possible to prevent erroneous operations of the washing machine.

Where the angular rotational acceleration of the drive motor 22 is more than the first predetermined value, but less than the second predetermined value (first predetermined value<α(i)<second predetermined value), the clutch operation discriminating algorithm is executed again.

The angular rotational acceleration of the drive motor 22 expressed by the above Expression can also be used as a value for sensing the amount of clothes and imbalance occurring before a spin-drying operation. In particular, a lower angular rotational acceleration of the drive motor 22 represents a larger amount of clothes. Also, an increased variation in the angular rotational acceleration of the drive motor 22 depending on a variation in time or rotating speed represents a greater imbalance.

Furthermore, the discrimination method in the clutch operation discriminating algorithm may use a value obtained by averaging time intervals of successive magnet sensing times for a given period of time. In this case, a shorter average time represents the disengagement of the float type clutch 80*a*, whereas a longer average time represents the engagement of the float type clutch 80*a*. Of course, appropriate discrimination conditions may be determined in accordance with load conditions and other surrounding conditions.

Although the preferred embodiments of the invention have been disclosed for illustrative purposes, those skilled in the art will appreciate that various modifications, additions and substitutions are possible, without departing from the scope and spirit of the invention as disclosed in the accompanying claims.

What is claimed is:

1. A washing machine comprising:

a drive motor;

a water reservoir tub for containing wash water to be supplied in a washing operation;

a wash tub received in the water reservoir tub;

a pulsator rotatably mounted to the bottom of the wash tub;

a hollow spin-drying shaft for rotating the wash tub in accordance with a rotating force from the drive motor;

a wash shaft extending through the spin-drying shaft while being fixedly connected at an upper end thereof to a wash shaft coupling member coupled to the pulsator and at a lower end thereof to the drive motor so as to normally and reversely rotate the pulsator in accordance with the rotating force from the drive motor;

a transmission including a plurality of bearings adapted to the spin-drying shaft and serving to efficiently transmit the rotating force from the drive motor to the wash tub and the pulsator;

a float type clutch including a float having a floating portion adapted to move upwardly or downwardly in accordance with whether or not wash water is present, a hollow cylindrical central portion provided at an upper end of an inner surface thereof with a float gear, and a "U"-shaped connecting portion integrally connecting the floating portion and the central portion, a spin-drying shaft gear provided at the upper end of the spin-drying shaft while having the same shape as the float gear so that it is selectively engagable with the float gear in accordance with a vertical movement of the float; and a barrier formed at a lower end of the wash shaft coupling member so that it is integral with the wash shaft coupling member, and inserted into the connecting portion of the float.

2. The washing machine according to claim 1, wherein at least one through hole is formed at a bottom of the connecting portion to allow a vertical introduction of wash water into a space defined by the connecting portion.

3. The washing machine according to claim 1, wherein at least one wash water introduction slit is formed at the floating portion to allow wash water to be introduced from an outer surface of the floating portion to a region around the central portion.

4. the washing machine according to claim 1, wherein a plurality of spaces are arranged in the form of a lattice at a lower side of the floating portion.

5. The washing machine according to claim 1, wherein the floating portion has a conical shape so that it has a diameter gradually reduced as it extends toward an upper end thereof.

6. A washing machine comprising:

a drive motor;

a water reservoir tub for containing wash water to be supplied in a washing operation;

a wash tub received in the water reservoir tub;

a pulsator rotatably mounted to the bottom of the wash tub;

a hollow spin-drying shaft for rotating the wash tub in accordance with a rotating force from the drive motor;

a wash shaft extending through the spin-drying shaft while being fixedly connected at an upper end thereof to a wash shaft coupling member coupled to the pulsator and at a lower end thereof to the drive motor so as to normally and reversely rotate the pulsator in accordance with the rotating force from the drive motor;

a transmission including a plurality of bearings adapted to the spin-drying shaft and serving to efficiently transmit the rotating force from the drive motor to the wash tub and the pulsator;

a float type clutch adapted to move upwardly or downwardly in accordance with whether or not wash water is present, so that it is engaged with or disengaged from the spin-drying shaft;

a barrier formed at a lower end of the wash shaft coupling member so that it is integral with the wash shaft coupling member, and inserted into the connecting portion of the float; and a rotation sensor installed beneath the drive motor, and adapted to sense rotating pulses generated from the drive motor.

7. A clutch control method for a washing machine with a float type clutch, comprising:

(A) a first predetermined water level determining step for determining whether or not wash water is supplied up to a first predetermined water level in a washing operation of the washing machine;

(B) a clutch disengagement algorithm executing step for shifting the float type clutch to its disengagement state in which a float gear and a spin-drying shaft gear included in the float type clutch are disengaged from each other, based on the result of the step (A);

(C) a second predetermined water level determining step for, when the float type clutch is shifted to its disengagement state, beginning a water supplying operation, and determining whether or not wash water is supplied up to a second predetermined water level depending on an amount of clothes to be washed;

(D) a washing and rinsing step for, when it is determined at the step (C) that wash water is supplied up to the second predetermined water level, washing and rinsing the clothes contained in a wash tub in accordance with washing and rinsing operations of the washing machine;

(E) a draining step for draining the wash water after completion of the washing and rinsing operations for the clothes contained in the wash tub at the step (D);

(F) a clutch engagement algorithm executing step for engaging the float gear, moving downwardly by its weight, with the spin-drying gear in accordance with a clutch engagement algorithm, after completion of the wash water drainage;

(G) a spin-drying step for rotating the wash tub in accordance with a spin-drying operation of the washing machine following the step (F), thereby spin-drying the clothes.

8. The clutch control method according to claim 7, wherein the clutch disengagement algorithm is carried out by repeatedly rotating the drive motor in a normal direction for a short period of time, and then repeatedly rotating the drive motor in a reverse direction for a short period of time, thereby releasing an engagement state of the float type clutch.

9. The clutch control method according to claim 8, wherein the clutch disengagement algorithm is carried out by repeatedly, that is, 2 to 5 times, turning on the drive motor for about 1 to 50 ms (milliseconds), and turning off the drive motor for about 0.1 to 1 second in association with a normal direction of rotation, and then repeats, 2 to 5 times, the turn-on/off operation in association with a reverse direction of rotation, the entire operation being carried out at least one time.

10. The clutch control method according to claim 7, wherein the clutch engagement algorithm is carried out by repeatedly rotating the drive motor in a normal direction for a short period of time, and then repeatedly rotating the drive motor in a reverse direction for a short period of time, thereby effectively obtaining an engagement state of the float type clutch.

11. The clutch control method according to claim 10, wherein the clutch engagement algorithm is carried out by repeatedly, that is, 2 to 5 times, turning on the drive motor for about 1 to 50 ms (milliseconds), and turning off the drive motor for about 0.1 to 1 second in association with a normal direction of rotation, and then repeats, 2 to 5 times, the turn-on/off operation in association with a reverse direction of rotation, the entire operation being carried out at least one time.

12. The clutch control method according to claim 10, wherein clutch engagement algorithm is carried out under a condition in which a rotating angle of the drive motor for one driving interval is set to be less than a gear pitch of the float and spin-drying shaft gears.

13. The clutch control method according to claim 7, wherein the clutch engagement algorithm is carried out by rotating, 2 to 5 times, the drive motor in one direction for a short period of time, thereby releasing an engagement of the float type clutch.

14. The clutch control method according to claim 7, wherein the clutch engagement algorithm is carried out by rotating, 2 to 5 times, the drive motor in one direction for a short period of time, thereby effectively obtaining an engagement state of the float type clutch.

15. The clutch control method according to claim 14, wherein clutch engagement algorithm is carried out under a condition in which a rotating angle of the drive motor for one driving interval is set to be less than a gear pitch of the float and spin-drying shaft gears.

16. A clutch control method for a washing machine with a float type clutch, comprising:

(A) a first predetermined water level determining step for determining whether or not wash water is supplied up to a first predetermined water level in a washing operation of the washing machine;

(B) a primary clutch operation discriminating algorithm executing step for, when it is determined that wash water is supplied up to the first predetermined water level, determining, using a clutch operation discriminating algorithm, whether or not the float type clutch is shifted to its disengagement state in which a float gear and a spin-drying shaft gear included in the float type clutch are disengaged from each other;

(C) a clutch disengagement algorithm executing step for, when it is determined at the step (B) that the float type clutch is not shifted to its disengagement state, disengaging the float gear from the spin-drying gear in accordance with a clutch disengagement algorithm;

(D) a second predetermined water level determining step for, when the float type clutch is shifted to its disengagement state, beginning a water supplying operation, and determining whether or not wash water is supplied up to a second predetermined water level depending on an amount of clothes to be washed;

(E) a washing and rinsing step for, when it is determined at the step (D) that wash water is supplied up to the second predetermined water level, washing and rinsing the clothes contained in a wash tub in accordance with washing and rinsing operations of the washing machine;

(F) a draining step for draining the wash water after completion of the washing and rinsing operations for the clothes contained in the wash tub at the step (E);

(G) a clutch engagement algorithm executing step for engaging the float gear, moving downwardly by its weight, with the spin-drying gear in accordance with a clutch engagement algorithm, after completion of the wash water drainage;

(H) a secondary clutch operation discriminating algorithm executing step for determining whether or not the float type clutch is in its engagement state in accordance with the clutch engagement algorithm; and (I) a spin-drying step for, when it is determined at the step (H) that the float type clutch is in its engagement state, rotating the wash tub in accordance with a spin-drying operation of the washing machine, thereby spin-drying the clothes.

17. The clutch control method according to claim 16, wherein the clutch operation discriminating algorithm discriminates whether or not the float type clutch operates, based on an angular rotational acceleration of the drive motor generated when the drive motor rotates in one direction for a predetermined time.

18. The clutch control method according to claim 17, wherein the clutch operation discriminating algorithm comprises the steps of:

discriminating the angular rotational acceleration of the drive motor; and determining the float type clutch to be in an engagement state when the discriminated angular rotational acceleration is less than a first predetermined value while determining the float type clutch to be in a disengagement state when the discriminated angular rotational acceleration is more than a second predetermined value, the second predetermined value being more than the first predetermined value.

19. The clutch control method according to claim 17, wherein the angular rotational acceleration of the drive motor is discriminated, based on a time interval between successive sensing times of a sensor for respective magnets installed on a shaft of drive motor.

20. The clutch control method according to claim 17, wherein the angular rotational acceleration of the drive motor is discriminated using a sensor for magnets installed on a shaft of drive motor, based on the following Expression:

$$\alpha(i)=\{4\pi\cdot[T(i)-T(i+1)]\}/\{N\cdot T(i)\cdot T(i+1)\cdot[T(i)+T(i+1)]\} \quad \text{[Expression]}$$

where, $\alpha(i)$: Average angular rotational acceleration for a period of time from an i-th sensing time to an "i+1"-th sensing time;

T(i): i-th sensing time;

N: Number of magnets;

Clutch engagement state: $\alpha(i)$<first predetermined value

Clutch disengagement state: $\alpha(i)$>second predetermined value; and first predetermined value<second predetermined value.

21. The clutch control method according to claim 17, wherein the angular rotational acceleration of the drive motor is used as a value for sensing the amount of clothes to be washed and imbalance occurring before a spin-drying operation so that a lower angular rotational acceleration of the drive motor represents a larger amount of clothes, and an increased variation in the angular rotational acceleration of the drive motor depending on a variation in time or rotating speed represents a greater imbalance.

* * * * *